US005375645A

United States Patent [19]

Brueker et al.

[11] Patent Number: 5,375,645

[45] Date of Patent: Dec. 27, 1994

[54] APPARATUS AND PROCESS FOR PRODUCING SHAPED ARTICLES FROM SEMISOLID METAL PREFORMS

[75] Inventors: Gordon W. Brueker, Holland; James L. Jalving, West Olive, both of Mich.

[73] Assignee: Micromatic Operations, Inc., Holland, Mich.

[21] Appl. No.: 6,161

[22] Filed: Jan. 19, 1993

Related U.S. Application Data

[63] Continuation of Ser. No. 842,807, Feb. 28, 1992, abandoned, which is a continuation of Ser. No. 621,235, Nov. 30, 1990, abandoned.

[51] Int. Cl.[5] ..... B22D 17/32

[52] U.S. Cl. ..... 164/457; 164/312; 164/155.4; 164/113; 164/900

[58] Field of Search ..... 164/457, 312, 155, 113, 164/900

[56] References Cited

U.S. PATENT DOCUMENTS

| | | |
|---|---|---|
| 2,649,693 | 8/1953 | Venus . |
| 3,840,364 | 10/1974 | Flemings et al. . |
| 3,842,895 | 10/1974 | Mehrabian et al. . |
| 3,902,544 | 9/1975 | Flemings et al. . |
| 3,936,298 | 2/1976 | Meharabian et al. . |
| 3,948,650 | 4/1976 | Flemings et al. . |
| 3,951,651 | 4/1976 | Mehrabian et al. . |
| 3,954,455 | 5/1976 | Flemings et al. . |
| 4,011,901 | 3/1977 | Flemings et al. . |
| 4,089,680 | 5/1978 | Flemings et al. . |
| 4,108,643 | 8/1978 | Flemings et al. . |
| 4,116,423 | 9/1978 | Bennett . |
| 4,174,214 | 11/1979 | Bennett et al. . |
| 4,194,552 | 3/1980 | Bennett . |
| 4,229,210 | 10/1980 | Winter et al. . |
| 4,345,637 | 8/1982 | Flemings et al. . |
| 4,372,360 | 2/1983 | Flemings et al. . |
| 4,397,687 | 8/1983 | Bye . |
| 4,415,374 | 11/1983 | Young et al. . |
| 4,434,837 | 3/1984 | Winter et al. . |
| 4,450,893 | 5/1984 | Winter et al. . |
| 4,457,354 | 7/1984 | Dantzig et al. . |
| 4,457,355 | 7/1984 | Winter et al. . |

(List continued on next page.)

FOREIGN PATENT DOCUMENTS 3123498 3/1983 Germany .

OTHER PUBLICATIONS

Patent Abstracts of Japan vol. 14, No. 287 (M-988) (4230) 21 Jun. 1990 and JP-A-2 089 554 (Toyo Mach & Metal Co. Ltd.) 29 Mar. 1990.

M. P. Kenney, et al. "Semisolid Metal Casting and Forging", *Metals Handbook*, vol. 15, 9th Ed, Casting, ASM International, Metals Park, Ohio 1968.

*Primary Examiner*—Kuang Y. Lin

*Attorney, Agent, or Firm*—Perman & Green

[57] ABSTRACT

Shaped metal articles are produced on a continuous basis from semisolid metal preforms. The metal preforms are sequentially heated, then transferred, without substantial deformation or heat loss to a press where they are shaped in the semisolid state into shaped articles. While in the press, a ram is employed to drive the preform into a cavity of adjacent tooling to thereby shape the article. Prior to the forming operation, the ram is first advanced until it lightly engages the preform, then is withdrawn by a spaced distance to a first position defining the beginning of a stroke. Then, the ram is advanced, rapidly, from the first position against the preform to a second position contiguous with the tooling, thereby defining the end of the stroke. The spaced distance is chosen so as to preclude substantial heat drain from the preform and/or forced entry of air into the cavity and/or splashing of the semisolid metal outside of the cavity. Just before reaching the second position, the ram may be accelerated to preclude the formation of voids in the finished article.

22 Claims, 3 Drawing Sheets

U.S. PATENT DOCUMENTS 4,465,118 8/1984 Dantzig et al. .
4,473,103 9/1984 Kenney et al. .
4,482,012 11/1984 Young et al. .
4,494,461 1/1985 Pryor et al. .
4,523,624 6/1985 Dantzig et al. .
4,524,820 6/1985 Gullotti et al. .
4,537,242 8/1985 Pryor et al. .
4,548,253 10/1985 Funatani et al. ..... 164/900
4,555,272 11/1985 Ashok et al. .
4,557,605 12/1985 Kenney et al. .
4,559,991 12/1985 Motomura et al. ..... 164/113
4,565,241 1/1986 Young .
4,569,218 2/1986 Baker et al. .
4,569,702 2/1986 Ashok et al. .
4,585,494 4/1986 Ashok et al. .
4,594,117 6/1986 Pryor et al. .
4,607,682 8/1986 Dantzig et al. .
4,687,042 8/1987 Young .
4,709,746 12/1987 Young et al. .
4,712,413 12/1987 Koch .
4,771,818 9/1988 Kenney .
4,801,360 1/1989 Tanner .
4,938,052 7/1990 Young et al. .
5,022,457 6/1991 Iwamoto et al. ..... 164/155

PRIOR ART

APPARATUS AND PROCESS FOR PRODUCING SHAPED ARTICLES FROM SEMISOLID METAL PREFORMS

This is a continuation of copending application(s) Ser. No. 07/621,235 filed on Nov. 30, 1990.

BACKGROUND OF THE INVENTION

1. Field of the Invention

This invention relates to an apparatus and process for producing shaped metal parts from semisolid metal preforms.

2. Description of the Prior Art

Vigorous agitation of metals during solidification is known to eliminate dendritic structure and produce a semisolid "slurry structured" material with thixotropic characteristics. It is also known that the viscosities of such materials may be high enough to be handled as a soft solid. See "Semisolid Metal Casting and Forging", M. P. Kenney et al., *Metals Handbook,* Vol. 15, 9th Ed., pp. 327–338, *Casting,* ASM INTERNATIONAL, Metals Park, Ohio, 1988. A pioneer patent broadly describing the concept is U.S. Pat. No. 3,842,895 to Mehrabian et al. which issued on Oct. 22, 1974.

Semisolid metals offer a number of significant benefits. Particularly significant for higher-melting alloys, semisolid metalworking affords lower operating temperatures and reduced metal heat content (reduced enthalpy of fusion). Also, the viscous flow behavior provides for a more laminar cavity fill than can generally be achieved with liquid alloys. This leads to reduced gas entrainment. Furthermore, solidification shrinkage is reduced in direct proportion to the fraction solidified within the semisolid metalworking alloy which, in turn, reduces both shrinkage porosity and the tendency toward hot tearing. Yet an added benefit resulting from the concept is that the viscous nature of semisolid alloys provides a natural environment for the incorporation of third-phase particles in the preparation of particulate-reinforced metal-matrix composites. In this instance, the enhanced viscosity of semisolid metalworking alloys serves to entrap the reinforcement material physically, allowing time to develop good bonding between the reinforcement and the matrix alloy.

However, processes for producing shaped parts from such slurry structured materials, particularly on a continuous basis, present a number of problems. Such processes require a first step of reheating a slurry structured preform charge to the appropriate fraction solid and then forming it while in a semisolid condition. At an earlier time, a crucible had been considered essential as a means of containing the material and handling it from its heating through its forming cycle. However, the use of such crucibles was recognized as costly and cumbersome and furthermore created process disadvantages such as material loss due to crucible adhesion, contamination from crucible degradation and untoward chilling from random contact with crucible side walls. Other problems are similarly involved in the heating, transport and delivery of preforms which are in a semisolid condition. Accordingly, a process was sought which would provide considerable manufacturing economy, particularly a process which would not require crucibles or other containing means and which is capable of operation on a continuous basis.

Such a process is disclosed in U.S. Pat. No. 4,569,218 which issued to Baker et al on Feb. 11, 1986, the entire disclosure of which is incorporated herein by references. As explained in that patent, it was found possible to produce on a continuous basis shaped metal articles from slurry structured freestanding metal preforms by sequentially raising the heat content of the preforms as they are passed through a plurality of induction heating zones. The heating sequence was such that it avoided melting and resulting flow and permitted thermal equilibration during transfers from one zone to the next as the preforms were raised to a semisolid temperature. That invention provided preforms which were substantially uniformly semisolid throughout. The freestanding semisolid preforms were then transferred to a press or other shaping station by means of mechanical transferring means which gripped the preforms with a very low force. This construction served both to prevent substantial physical deformation of the semisolid preform and reduced heat loss. The transferring means were also heated if desired to even further minimize heat loss of the preforms during transfer.

Notwithstanding the substantial advances which were presented in the patent to Baker et al., some problems have persisted with the process as it was then known. For example, with placement of the metal preform in the press with the ram positioned contiguous to the preform in preparation for the forming operation, the ram undesirably served as a heat sink substantially lowering the temperature of the preform. Such temperature reduction of the preform altered the characteristics of the resulting article and thereby impaired the benefits sought to be obtained by use of a semisolid preform. In order to avoid this condition, the natural inclination was to withdraw the ram a substantial distance from the preform immediately prior to the forming operation. In this case the end of the ram was preset to a relatively generous distance from the article before the ram was activated for the forming step. This was done manually by a set up man who had to physically place himself in and around the press to set limit switches in combination with the position of the ram. This set up procedure is dangerous, very time consuming and cannot be carried out very precisely. In addition, this manual approach to correcting for the earlier described situation has other serious drawbacks. Specifically, air in front of the ram is captured by the ram and forced into the interstices of the metal preform as it enters the cavity of the tooling used to form the final article. This can have a deleterious effect of a resulting article having air field voids in its structure. Such articles would, as a result, be weaker than solid articles having the same configuration.

Another undesirable occurrence is possible when the ram has been withdrawn a substantial distance from the preform immediately preceding the inception of the preform operation. In this instance, as the ram advanced rapidly into engagement with the preform, there was often sufficient deformation of the preform to enable some of its substantial liquid content to splatter outside of the cavity of the tooling, thereby reducing the volume of the formed article. The volume of the preform is precisely determined in order to arrive at a formed article which is solid and complete in all respects. Hence, if material present in the preform does not find its way into the cavity of the tooling, the finished article will either have voids in it or it will be incomplete. In either event, the resulting article will not be satisfactory for its intended purpose.

SUMMARY OF THE INVENTION

It was with knowledge of the foregoing that the present invention has been conceived and reduced to practice. According to the invention, shaped metal articles are produced on a continuous basis from semisolid metal preforms. The metal preforms are sequentially heated, then transferred, without substantial deformation or heat loss to a press where they are shaped in the semisolid state into shaped articles. While in the press, a ram is employed to drive the preform into a cavity of adjacent tooling to thereby shape the article. Prior to the forming operation, the ram is first advanced until it lightly engages the preform, then is withdrawn by a relatively small, spaced distance, or gap, from the preform to a first position defining the beginning of a stroke. This is in the nature of a set up procedure for the particular preform, the gap between the end of the ram and preform being sized precisely, quickly and safely relative to the preform. Then, for all subsequent operational strokes of the ram, the ram is advanced, rapidly, from the first position against the preform to a second position contiguous with the tooling, thereby defining the end of the stroke. The spaced distance is chosen so as to preclude substantial heat drain from the preform and/or forced entry of air into the cavity and/or splashing of the semisolid metal outside of the cavity. Just before reaching the second position, the ram may be accelerated to preclude the formation of voids in the finished article.

The invention envisions both semi-automatic and automatic operation of the machinery resulting in the finished article. In the semi-automatic mode, a metal preform is placed in the press whereupon the ram is lowered until it contacts or lightly engages the top of the preform. Thereupon, the ram is raised from the preform by the spaced distance noted above, for example, about 1/16 inch. This position is then established by means of an encoder working in conjunction with the ram. In this manner, subsequent operational strokes of the ram may be performed under the control of a computer from a central control panel for subsequent identical operations on succeeding metal preforms.

A similar operation may take place in the automatic mode. In this instance, however, the computer software would be programmed so as to take into account the prescribed distance for a prescribed preform for a prescribed article to be formed. The desired gap distance between the end of the ram and the top of the preform can be determined as described above for a particular part number and information relating to it entered into the computer's memory for access in a well known manner whenever desired. The computer can be programmed so that whenever that part number is desired to be formed, the information controlling the ram position is looked up in the memory and the ram is automatically set to the required position, i.e. its first position. With such an arrangement, whenever a new part number is to be formed, the operator would simply inform the computer through a keyboard at the control panel, such as by inputting the part number, which article is being formed. Thereupon, the ram would automatically be set at the proper position to provide the spaced distance, or gap, such as part of the entire sequence of operations beginning with heating of the preform, advancing the preform into the press, and removing the formed article from the press.

By reason of the fact that the spaced distance of the ram from the preform is attained by the operator at the control panel and distant from the press, safety is an added benefit of the invention. In addition, the operation is quicker and the gap distance can be more precisely controlled than previously known.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

DESCRIPTION OF THE PREFERRED EMBODIMENTS

The starting preform used in the practice of the present invention is a metal alloy, including but not limited to, such alloys as aluminum, copper, magnesium or iron, which has been prepared in such a fashion as to provide a "slurry structure". This may be done by vigorously agitating the alloy while in the form of a liquid-solid mixture to convert a substantial proportion, preferably 30% to 55% by volume, of the alloy to a non-dendritic form. The liquid-solid mixture is then cooled to solidify the mixture. The resulting solidified alloy has a slurry structure. A "slurry structured" material, as used herein, is meant to identify metals having a microstructure which upon reheating to a semisolid state contain primary spherical solid particles within a lower melting matrix. Such slurry structured materials may be prepared without agitation by a solid state process involving the production, e.g., by hot working, of a metal bar or other shape having a directional grain structure and a required level of strain introduced during or subsequent to hot working. Upon reheating such a bar, it will also contain primary spherical solid particles within a lower melting matrix. One method of forming the slurry structured materials by agitation is by use of a rotating magnetic field. A preferred method of preparing the preforms is, however, by the solid state process which is disclosed more fully in U.S. Pat. No. 4,415,374 issued Nov. 15, 1983.

The present invention is particularly useful for the production of relatively small shaped articles, i.e. parts whose largest dimension is less than six inches. Beyond this size, freestanding preforms become increasingly difficult to handle in a semisolid condition. Starting preforms may therefore conveniently be in the form of cylindrical slugs produced by cutting off suitable lengths of a cast or extruded slurry structured bar. The invention will be illustrated in connection with the use of such slugs. The forming process of articles from such slugs has been called by many names interchangeably in the past including semisolid metal forging, semisolid metal extruding, semisolid metal forming, etc.

Figure 1:
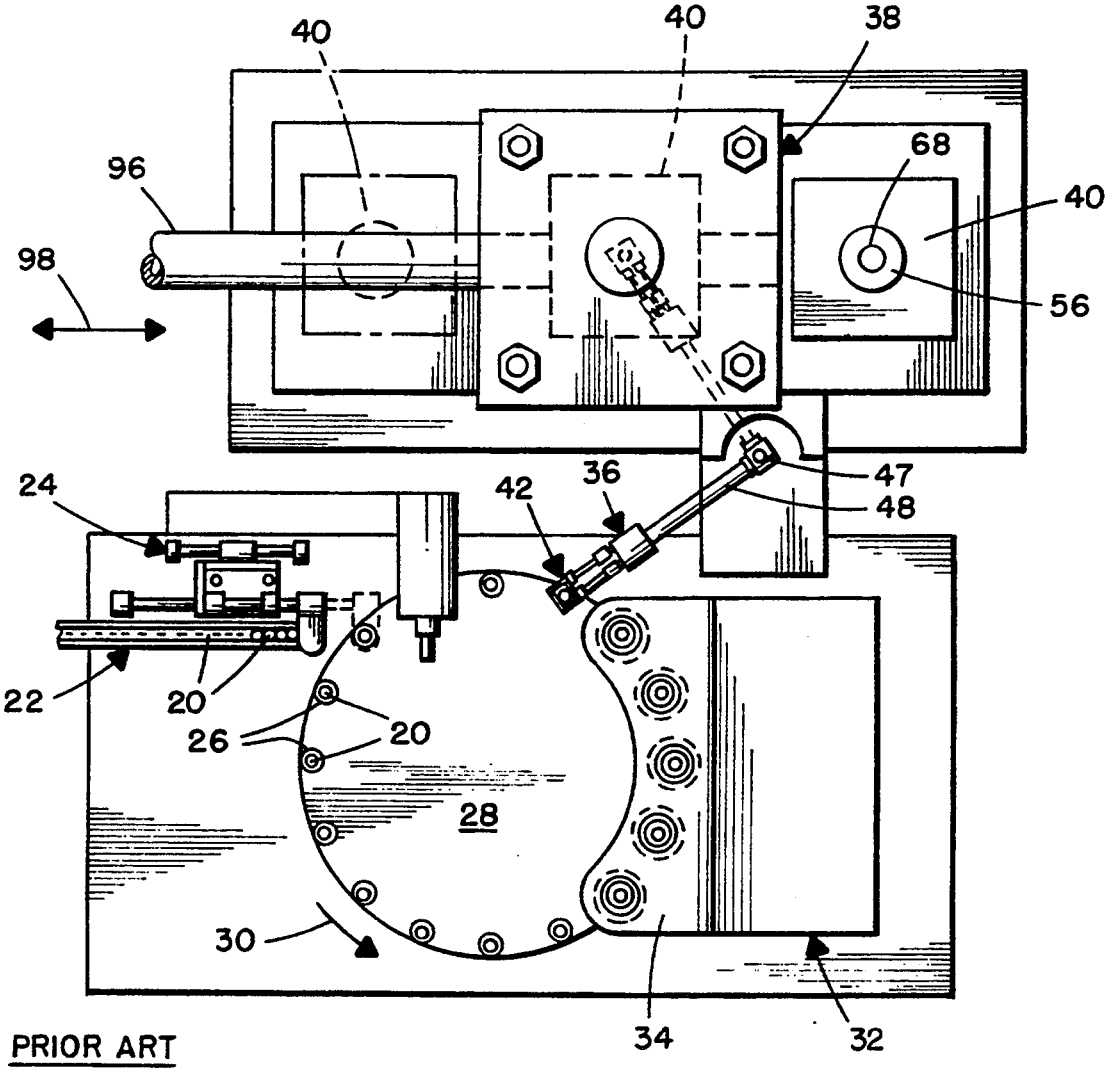
FIG. 1 is a partially schematic plan view of one embodiment of apparatus useful in the practice of the invention.
Figure 2:
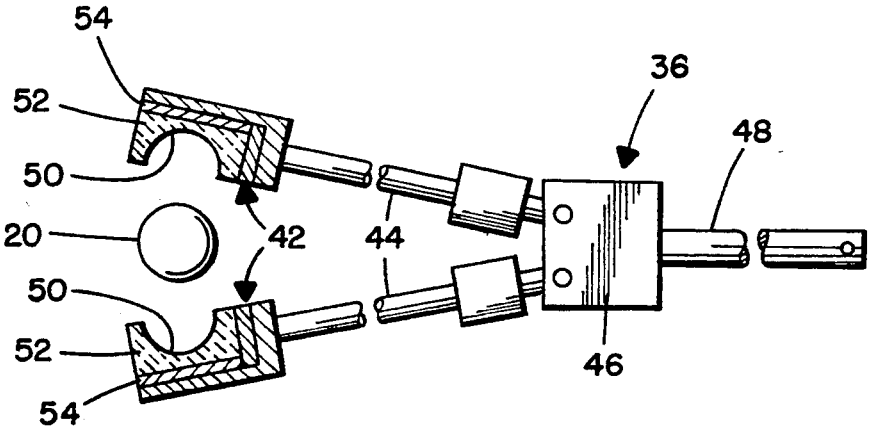
PRIOR ART FIG. 2.
FIG. 2 is an enlarged plan view of the mechanical gripper utilized with the apparatus of FIG. 1.
Figure 3:
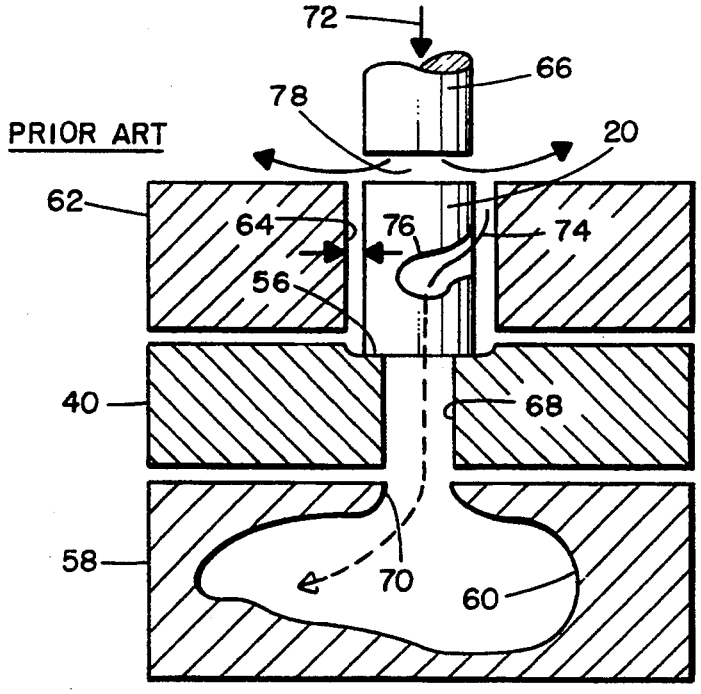
FIG. 3 is a diagrammatic elevation view, partly in section, illustrating the press utilized by the invention.

Turn now to the drawings and, initially, to FIGS. 1, 2, and 3 which depict the prior art. As shown in FIG. 1, such metal preforms 20 are fed onto a stacker 22 in a single ordered row, as, for example, from a commercially available vibratory bowl feeder (not shown). From stacker 22, they are lifted by a loading dial 24 and placed onto an insulated pedestal 26 on rotatable table 28, each pedestal having a thermal insulating cap. The table 28 is rotatable in the direction of arrow 30 and contains around its periphery a series of such insulated pedestals, each of which supports and positions a freestanding metal preform 20. An induction heater 32 is mounted at a side of the rotatable table 28 opposite the stacker 22 and the loading dial 24. The induction heater comprises a hood 34 containing a series of coils forming a series of induction heating zones. The induction heater is vertically movable from a first elevated position, as shown in FIG. 1, when table 28 is in the process of being indexed to the next consecutive pedestal-preform position to a second descended position in which the induction heating zones enclose a series of adjacent preforms—five in the embodiment shown in the drawing—to raise their heat content.

During this period, the horizontal centerline of the preforms should be below the centerline of the coils of the induction heater to avoid levitation of the preforms. Each of the induction heating zones heats the adjacent preforms to a sequentially higher level in the direction of movement of the table 28 so that the preform about to emerge from the induction heater, i.e., in its final position in the heater, is in a uniformly semisolid condition, preferably 70 to 90% by volume solid, remainder liquid. If it is desired to increase the heating rate, the heat content of the preforms should be raised at an intermittent or pulsating rate, over either a portion of or the entire heating cycle, preferably at least from the onset of melting of the preform to the final semisolid level. In the first two or three coils, before liquid formation in the preform, the temperature rise may be rapid. In the last two or three coils, the temperature rise may be at a slower rate, at lower power input. This shortens the total time to final temperature without encountering alloy flow problems. In order to accomplish this, the five coils may be wound in series but with a differing number of turns on the various coils. The first two or three coils, those into which the preforms enter first, may be densely wrapped and provide high magnetic flux while the remaining coils are less densely wrapped and provide a lower magnetic or soaking flux.

After the table has indexed a preform 20 from its final position in the heater to a first position external to the heater, a pair of grippers 36 mechanically grips and removes the preform from its pedestal, rotates to a position aligned with the die of a press 38 and deposits the preform on a plate 40 of the press where the preform, in a semisolid state, is shaped into a metal article. The transfer must be carried out under conditions which insure a minimum of deformation of the semisolid preform. The transfer must also create little or no local variation in fraction semisolid (or local heat transfer) within the preform. The grippers 36 are accordingly designed to minimize heat transfer from the preform to the transferring means.

The grippers 36 comprise a pair of gripping jaws 42, preferably containing electrical resistance heating means embedded therein. As shown more clearly in FIG. 2, the gripping jaws are attached to gripper arms 44 which are pivotably mounted for adjustment of the distance therebetween on a gripper actuator 46 which may be an air powered cylinder. The actuator is in turn pivotably mounted on a suitable support 47 through an actuator arm 48 for transferring the preforms from the table 28 to the press 38. A surface 50 of the gripping jaws is machined from a refractory block 52 to have a contour closely matching the contour of the semisolid metal preform 20. A thermal barrier 54 is sandwiched between the block 52 and gripping jaw 42. Embedded in each of the refractory blocks 52 is an electrical resistance heater rod (not shown) which may be suitably connected to an electrical power source. The gripping jaws are heated to minimize the chilling effect of the gripper material on the semisolid preform. For aluminum alloy preforms, the face of the jaws of the grippers may, for example, be plasma sprayed alumina or magnesia; for copper alloys, the face may be a mold washed steel refractory coating or high density graphite. The surface of the grippers 36 may be heated to a temperature substantially above room temperature but below the liquid's temperature of the preforms. The gripping surface of the jaw faces should be maximized so as to minimize deformation of the preform, with the gripper jaw circumference and radius of curvature being close to that of the preform.

The press 38 may be a hydraulic press ranging from 4 to 250 tons equipped with dies appropriate to the part being shaped. The press may be actuated by a commercially available hydraulic pump sized to meet the tonnage requirements of the system. Suitable times, temperatures and pressures for shaping parts from slurry structured metals are disclosed in Canadian Pat. No. 1,129,624, issued Aug. 17, 1982.

The induction heating power supply for the system may range in size from 5 to 550 KW and may operate at frequencies from 60 to 400,000 hertz. The precise power capability and frequency are selected in accordance with the preform diameter and heating rate required. Typically, for example, the power requirement may range from $\frac{1}{4}$ to 1 KW per pound per hour of production required.

The actuator arm 48 is thus swung from the solid line position to the dashed line position as illustrated in FIG. 1 to deliver a semisolid metal preform 20 for placement on an appropriately recessed central portion 56 of the support plate 40 in the press 38. Appropriate tooling 58 with a recess 60 therein, which is precisely shaped in accordance with the formed article desired, is positioned immediately beneath the support plate. When the metal preform 20 has been placed on the support plate 40, a ring clamp 62 with a centrally positioned bore 64 therethrough descends so as to snugly encircle the metal preform 20. By way of example, the clearance between the ring clamp 62 and the metal preform 20 is approximately 0.005 inches. When the metal preform 20 is at rest on the plate 40, it is aligned with a ram 66 whose diameter is substantially similar to that of the metal preform and, therefore, has minimal clearance with respect to the bore 64. Also aligned with the ram 66 and with the metal preform 20 is a delivery passage 68 which extends through the support plate 40. The delivery passage 68 is in communication with the cavity 60 via an inlet 70 in the tooling 58.

With operation of the press 38, the ram 66 advances rapidly in the direction of an arrow 72 thereby forcing the material in the metal preform through the delivery passage 68, through the inlet 70, and into the shaped cavity 60. It was previously explained that although this known procedure generally results in finished articles which are of a superior quality than earlier known casting or forging operations utilizing substantially solid preforms, some difficulties have arisen which it is the intention of the present invention to correct. According to one of the difficulties, the ram 66 was positioned substantially contiguous with the metal preform 20 immediately prior to inception of the forming operation. In this instance, even when the support plate 40 was heated in order to maintain the temperature of the metal preform, it was found that the ram 66 served as a heat sink drawing heat from the preform and cooling it below a temperature at which the benefits of semisolid metal forming can be achieved.

In a converse manner, it has also been found that if the face of the ram 66 is too far distant from the upper surface of the metal preform 20 immediately prior to inception of the forming operation, other difficulties are experienced. One such difficulty is that air pushed into the bore 64 of the ring clamp 62 and around the metal preform 20, as schematically represented by an arrow 74 can generate an air bubble 76 in the metal preform before the semisolid metal flows into the cavity 60 of the tooling 58. Undesirably, the air bubble would remain within the semisolid metal structure and become a part of the finished article.

In another instance, if the ram 66 impacts too vigorously against the top surface of the metal preform 20, it may cause the liquid portions of the preform 20 to splatter, that is, to leave the confines of the metal preform thereby reducing the volume of the semisolid metal which is intended to travel into the cavity 60. This would result in reduction of the volume of metal, and therefore in the quality, of the final article. It was previously explained that the volume and/or weight of the metal preform 20 is precisely measured beforehand for the particular article to be formed such that loss of some amount of the metal is highly undesirable.

It has been found that all of the drawbacks of the process just mentioned can be avoided if an optimal spacing 78 is employed. In a representative preform type, such an optimal spacing should preferably be no greater than about ¼ inch although it would preferably be about 1/16 inch.

Figure 4A:
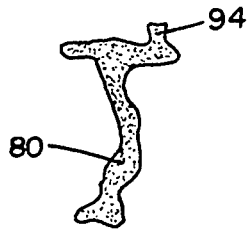
FIG. 4A is a side elevation view of an article formed by the process of the invention.

With the optimal spacing 78 provided in accordance with the invention, each of the difficulties described above has been eliminated. That is, there is sufficient spacing between the ram 66 and the metal preform 20 prior to inception of the forming operation that heat drain from the metal preform is within acceptable limits. Also, the spacing is sufficiently small that there is no substantial tendency for air bubbles 76 to be formed. Finally, the spacing 78 is sufficiently small that any impact of the ram 66 on an upper surface of the metal preform 20 is sufficiently small that there is no effective splattering of liquid portions of the preform. In this manner, it is assured that substantially the entire volume of the metal preform 20 is transferred to the cavity 60. It will be appreciated that the shape of the tooling 58 and of its cavity 60 in FIG. 3 are diagrammatic only and are not intended to be representative of a final article 80 (FIG. 4A) which results from the metal forming operation of the invention.

Figure 4:
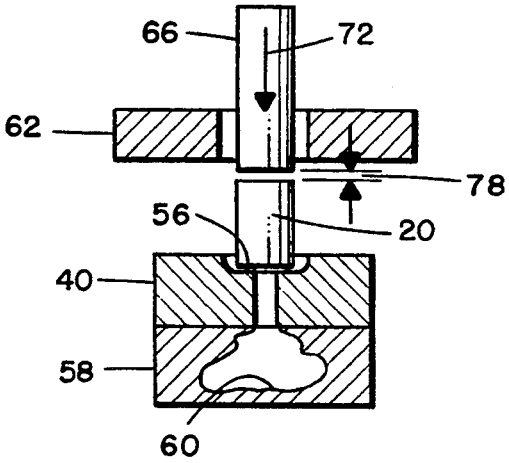
FIG. 4 is a side elevation view, similar to FIG. 3, illustrating the practice of the present invention.
Figure 6:
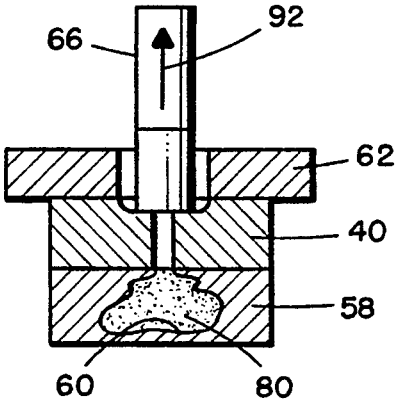
FIG. 6 is a diagrammatic view, similar to FIG. 4, illustrating a subsequent step in the operation of the process of the invention.

With the aid of FIGS. 4, 5, and 6, the method of the present invention will now be described. Viewing FIG. 4 first, the semisolid metal preform 20 is placed on the recessed central portion 56 of the support plate 40. At this stage of the process, the ring clamp 62 is in a raised position to enable the placement of the metal preform. Thereafter, the ring clamp 62 is lowered to the position illustrated in FIG. 3.

Figure 5:
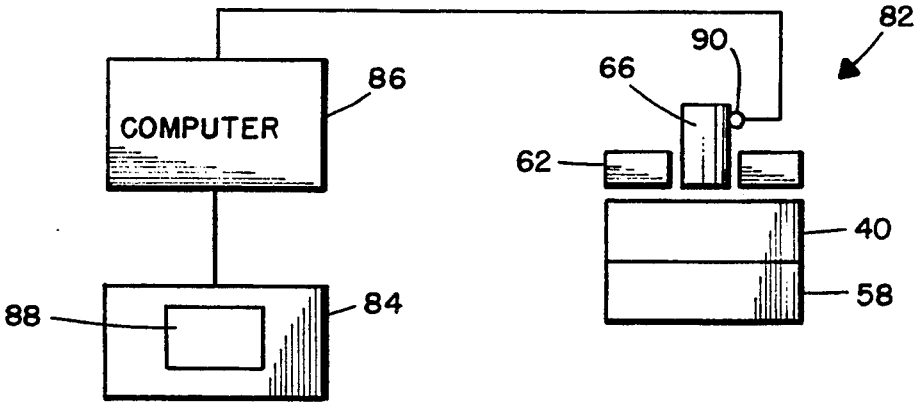
FIG. 5 is a diagrammatic illustration of a control system for the invention.

As seen in FIG. 5, the invention includes a control system 82 which includes a control panel 84 which, in combination with a computer 86, serves to operate the system broadly illustrated in FIG. 1. By means of a keyboard 88, which can be part of computer 86, or alternatively part of another separate computer such as a personal computer operatively connected with computer 86 and the press, the operator first advances the ram 66 until it lightly engages the metal preform 20. Then, he withdraws the ram from the metal preform by the spaced distance 78 as previously explained. The computer and operator can determine the point at which ram 66 lightly engages the preform in any suitable manner. For instance, the force on the ram necessary to drive it down after it lightly engages the preform will increase dramatically compared to just before such engagement is made. This can be sensed and fed back to computer 86. Of course, a substitute for the metal preform, per se, may be used having a similar height from which the spaced distance 78 can be determined. This establishes a first position which defines the beginning of the operational stroke to be taken by the ram. With the keyboard 88, the operator can utilize encoder 90 to determine the spaced distance 78. If the encoder used is of the analog output type, one would have to connect it to an analog-to-digital convertor so that data on the ram, such as ram position, ram displacement, or other types of suitable ram information, from the encoder can be read by the computer. A suitable encoder for this application is Model No. MT40E-XHSB256N16XDY-CREC22X5 sold by BEI Electronics, Inc. of Santa Barbara, Calif. The encoder 90 is positioned adjacent the ram and can serve to measure absolute position, incremental movement, or other suitable characteristics of the ram. The ram can have a rack mounted thereon which engages and rotates a pinion which lies adjacent the rack so that as the rack and ram move up and down, the pinion, which has a supporting shaft which is stationary relative to the rack, is rotated. The encoder wheel can be mounted on the same shaft as pinion and rotate with the pinion. In this manner the exact position of the ram, or end of the ram adjacent the preform, can be monitored. The encoder is electrically connected to the computer 86 which may be a programmed linear controller, such as Model PLC 5/25, sold by Allen Bradley Corporation, Milwaukee, Wis.

The computer 86, which may be programmed with the entire sequence of the metal forming operation, then is effective to cause proper movement of the ram 66 to form the article 80. Thereupon, viewing FIG. 6, with the article 80 formed within the cavity 60 of the tooling 58, the ram 66 is caused to retreat or return in the direction of arrow 92. Thereafter, the ring clamp 62 retreats or returns to the FIG. 3 position and the tooling 58 is removed from the article 80 in a known manner. A biscuit 94 resulting from excess material which solidified in the inlet 70 of the tooling 58 is suitably removed as by machining. Thereafter, the article 80 is suitably transferred to another location for any subsequently desired processing.

The apparatus and method of the invention can be operated in a semi-automatic mode to set up the first position for a given metal preform. In this case, the preform is placed in the press and, then, under the operation of the computer, the ram is lowered until it contacts or lightly engages the top of the preform. Thereafter the ram is withdrawn above the preform by the desired spaced distance 78 for the given preform, as determined with the aid of the optical encoder 90. Once the desired spaced distance is reached, the position of the ram, as determined by the encoder, is placed in the memory of the computer to control the position of the end of the ram at the beginning of its work stroke; i.e. the first position for the given preform. This set up procedure can be used each time that another given preform is to be placed in position on the support plate 40 within the press 38.

Figure 8:
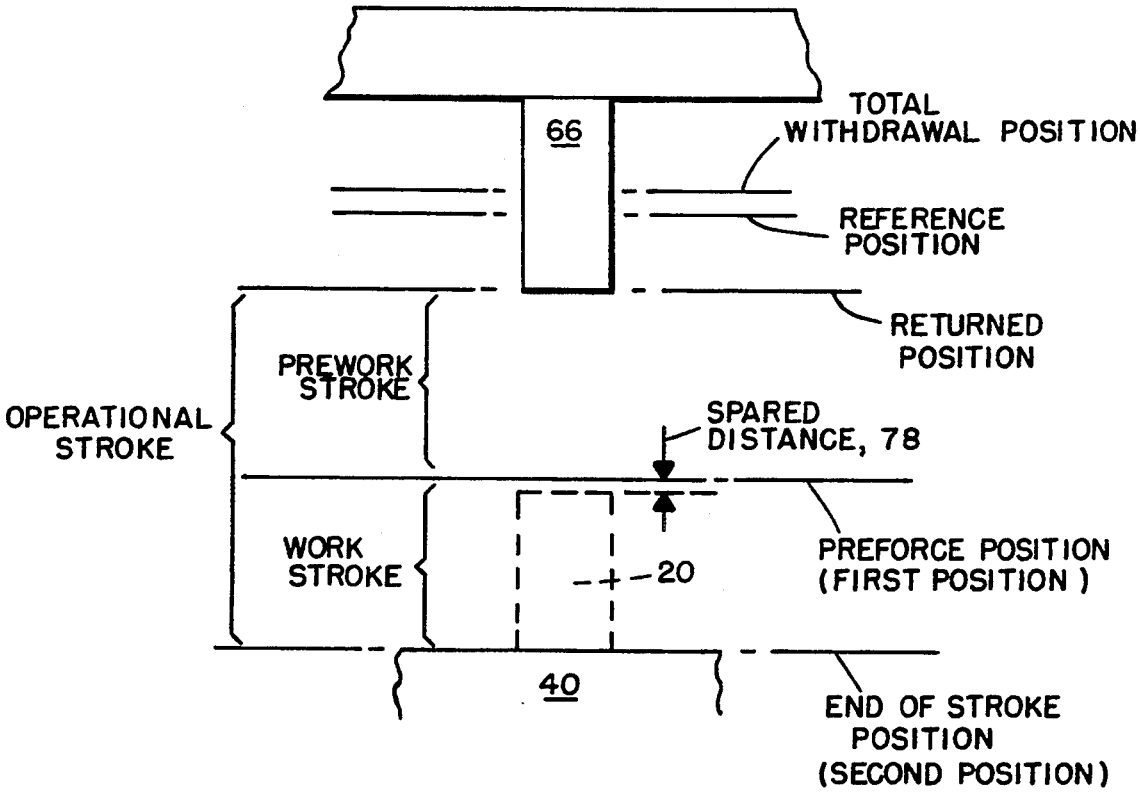
FIG. 8 is a diagrammatic illustration of the various portions of the ram.

The relative positions of ram 66 are shown diagramatically in FIG. 8. In the example shown in FIG. 8, reference lines relate to the end of the ram position. Ram 66 has a "total withdrawal position" at which it is prevented from retracting further, usually by a hard stop. It also has a "reference position", just below the total withdrawal position, at which encoder 90 is at a "zero" or absolute position, for example a position from which the encoder begins measuring, or counting, the position of or travel of the ram. During the set up procedure, the ram is lowered to lightly engage the top of a given preform and then retracted to the "preforge position", or the first position. This position is then placed in the computer's memory so that the work stroke of the ram will always begin at this position for the given preform. After this set up procedure is completed, the apparatus is ready for an operational stroke. The operational stroke comprises two phases, a prework stroke and a work stroke. The operational stroke begins with the ram leaving its "returned position" and traveling or dropping towards its preforge position at low speed and under low ram pressure. When it reaches its preforge position, as predetermined from the given preform during the set up procedure, pressure is developed to bring ring clamp 62 into its position around the preform and to place a high pressure, high speed condition on the ram. When these conditions are met, the ram travels through the work stroke to the "end of stroke" position. The ram is then withdrawn back to its returned position where it stops and waits, if necessary, for the next preform to be placed on support plate 40. The ring clamp also retracts during this time. After the next preform is in position, the next operational stroke begins.

It is envisioned that the apparatus of the invention can also be operated in an automatic mode. In this embodiment, computer software would be programmed with the proper sequence of events associated with a particular article to be formed. In this instance, the operator would inform computer 86 by way of keyboard 88 at the control panel 84 as to the particular article intended to be formed, such as by part number of that preform or final article to be formed from it. The ram position information on the spaced distance 78 for that part number would be preloaded into the computer memory. When the part number is entered by the operator the software program would look up the ram position information in the memory and set the ram position, i.e. the first position, automatically. Thereupon, the ram would be automatically spaced from the preform by the proper space distance 78 and all other operations would also take place according to the desired sequence. Such a desired sequence could include initial heating of the preform, advancing the preform into the press, performing the forming operation itself, and subsequently removing the formed article from the press for subsequent operations.

Returning to FIG. 1, it has been found desirable to provide the press 38 with a pair of spaced support plates 40 operated by a handling rod 96. The rod 96 is effective to sequentially move the support plates 40 from an operating position aligned with the ram and respective withdrawn positions displaced from the ram. Hence, as seen in FIG. 1, the support plate 40 illustrated in solid lines is in the withdrawn position displaced from the ram, and the support plate 40 illustrated by dashed lines is in the operating position aligned with the ram. The support plate 40 illustrated by dashed dot lines is really the dashed line support plate in its withdrawn position. In order for the support plates 40 to achieve these several positions, the handling rod 96 is reciprocably movable, generally as indicated by a double arrow 98. The actuating arm 48, or some other suitable expedient, may be used to remove a finished article from the support plates 40 following the forming operation. This would preferably be accomplished with the support plates in their withdrawn positions.

Figure 7:
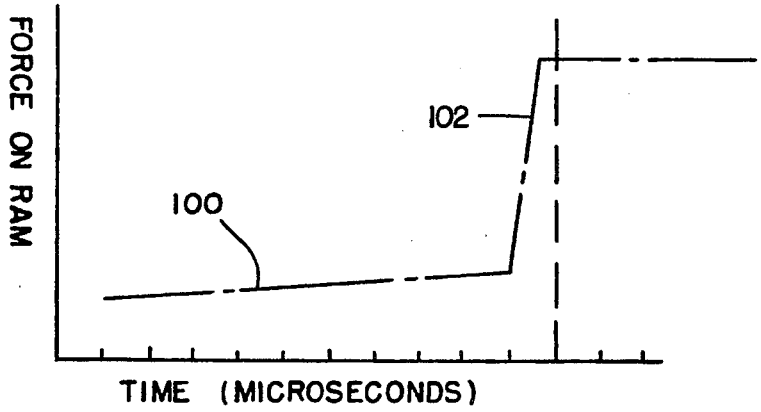
FIG. 7 is a graph illustrating a mode of operation of the invention.

Yet another expedient for purposes of the present invention will now be explained with the aid of FIG. 7. A curve 100 is illustrative of the force imparted on the ram 66 over the period of its operation. As was previously mentioned, when forming the article 80, the metal preform 20 is approximately 75% solid and 25% liquid. The liquid portion shrinks when cooled in the tooling 58. By operating the ram 66 in the manner indicated in FIG. 7, that is, by imparting a severe acceleration, or speed spike, at the end of the ram's stroke, as indicated at 102, any shrinkage caused by solidifying liquid is filled by solid material to assure that there will be no voids in the final product. That is, the acceleration of the ram indicated by the modified curve 102 imparts additional pressure on the metal within the delivery passage 68 to further compact the material within the cavity 60.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. Apparatus for forming an article from a free-standing metal preform composed of a homogeneous slurry structured metal alloy with thixotropic characteristics maintained substantially at a predetermined temperature in a uniformly semisolid condition being in the range of approximately 70% to 90% solid by volume, the remainder being liquid, without causing substantial introduction of air into the resulting article and without causing substantial splattering of the liquid portions of the preform outside of a mold cavity, said apparatus comprising:

tooling means defining a mold cavity having the shape of the article to be formed and including substantially flat platform means for supporting the metal preform adjacent the mold cavity therein;

ram means for rapidly impressing the metal preform into the mold cavity, said ram means being movable between a first position spaced from an initial location corresponding to a surface of the metal preform nearest said ram means when the preform is positioned on said platform means adjacent the mold cavity thereby defining the beginning of a work stroke for said ram means and a second position contiguous with said tooling means thereby defining the end of a stroke of said ram means;

said ram means including encoder means for establishing said first position as a norm repeatable for successive operations on successive metal preforms, said first position being spaced from the initial location by a distance adequate to preclude an undesirable condition from occurring including at least one of substantial heat drain from the preform and forced entry of air into the cavity and substantial splashing of the semisolid metal outside of the mold cavity.

2. Apparatus for forming an article as set forth in claim 1 including computer means responsive to said establishing means for operating said apparatus to form articles from subsequent preforms in an identical manner.

3. Apparatus for forming an article as set forth in claim 1 including:

handling means for advancing the metal preform into position adjacent the cavity in said tooling means prior to movement of said ram means and for removal from said tooling means of the formed article following movement of said ram means.

4. Apparatus for forming an article as set forth in claim 1:

wherein said tooling means includes first and second tooling members, each having a cavity therein the shape of the article desired for selectively receiving, adjacent the cavity, the metal preform to be operated upon; and delivery means for moving said first tooling member from a first withdrawn position to an operating position aligned with said ram means and for simultaneously moving said second tooling member from said operating position to a second withdrawn position; and handling means for placing the metal preform into position adjacent the cavity in said first and second tooling members prior to movement of said ram means and for removing the formed article from said first and second tooling members following movement of said ram means.

5. Apparatus for forming an article as set forth in claim 1 wherein said ram means includes driving means for accelerating said ram means immediately before said ram means reaches said second position.

6. Apparatus for forming an article as set forth in claim 1 including heating means for heating the metal preform to a level at which the metal preform becomes partially liquid and partially solid.

7. Apparatus for forming an article as set forth in claim 1 wherein said means for establishing said first position is operable for establishing the spaced distance as being no greater than approximately $\frac{1}{4}$ inch.

8. Apparatus for forming an article as set forth in claim 1 wherein said means for establishing said first position is operable for establishing the spaced distance as being approximately 1/16 inch.

9. Apparatus for forming an article as set forth in claim 1 including computer means electrically coupled with said encoder means for operating said ram means according to a particular article desired.

10. Apparatus for forming an article as set forth in claim 9 wherein said computer means is operable to adjust the spaced distance according to the particular article being formed.

11. A method of forming an article from a semisolid metal preform comprising the steps of:

placing the metal preform adjacent a cavity in tooling means having the shape of the desired article;

advancing a ram until it lightly engages the metal preform, the position of the ram relative to the preform being monitored by an encoder means;

withdrawing the ram from the metal preform by a spaced distance to a first position defining the beginning of a stroke, the spaced distance being determined by the encoder means; and advancing the ram a second time, rapidly, from the first position against the metal preform to a second position contiguous with the tooling, thereby defining the end of the stroke, for impressing the preform into the cavity of the tooling, the spaced distance being adequate to preclude an undesirable condition from occurring including at least one of substantial heat drain from the preform and forced entry of air into the cavity and splashing of the semisolid metal outside of the cavity.

12. A method of forming an article as set forth in claim 11 including the step of:

establishing the first position as a norm repeatable for successive operations on successive metal preforms.

13. A method of forming an article as set forth in claim 11 including the steps of:

providing first and second tooling means;

moving the first tooling means from a first withdrawn position to an operating position aligned with the ram means and for simultaneously moving the second tooling means from the operating position to a second withdrawn position;

placing a metal preform into position adjacent the cavity in the first tooling means prior to movement of the ram means; and removing the formed article from the first tooling means following movement of said ram means.

14. A method of forming an article as set forth in claim 13 including the steps of:

moving the second tooling means from the second withdrawn position to the operating position aligned with the ram means and for simultaneously moving the first tooling means from the operating position to the first withdrawn position;

placing the metal preform into position adjacent the cavity in the second tooling means prior to movement of the ram means; and removing the formed article from the second tooling means following movement of said ram means.

15. A method of forming an article as set forth in claim 14 including the step of:

automatically and continuously repeating all of the preceding steps.

16. A method of forming an article as set forth in claim 11 including the step of:

accelerating the ram immediately before it reaches the second position.

17. A method of forming an article as set forth in claim 11 including the step of:

heating the metal preform to a level at which it becomes partially liquid and partially solid.

18. A method of forming an article as set forth in claim 11 wherein the spaced distance is no greater than approximately ¼ inch.

19. A method of forming an article as set forth in claim 11 wherein the spaced distance is approximately 1/16 inch.

20. Apparatus for forming an article as set forth in claim 1 wherein said encoder means is operable for marking said first position and measuring the travel of said ram means away from said first position as it moves toward said second position; and wherein said ram means is responsive to said encoder means to return successively to said first position after achieving said second position.

21. A method of forming an article from a semisolid metal preform comprising the steps of:

placing an initial metal preform adjacent a cavity in tooling means having the shape of the desired article;

advancing a ram until it lightly engages the initial metal preform, the position of the ram relative to the initial metal preform being monitored by an encoder means;

withdrawing the ram from the initial metal preform by a spaced distance to a first position defining the beginning of a stroke, the spaced distance being determined by the encoder means; and advancing the ram a second time, rapidly, from the first position against the initial metal preform to a second position contiguous with the tooling, thereby defining the end of the stroke, for impressing the initial metal preform into the cavity of the tooling;

withdrawing the ram from the second position to the first position;

placing a subsequent metal preform adjacent the cavity in the tooling means having the shape of the desired article;

advancing the ram, successively, rapidly, from the first position to the second position for the subsequent metal preform for impressing the subsequent metal preform into the cavity of the tooling;

the spaced distance being adequate in each instance to preclude an undesirable condition from occurring including at least one of substantial heat drain from the preforms and forced entry of air into the cavity and splashing of the semisolid metal outside of the cavity.

22. A method of forming an article from a free-standing semisolid metal preform comprised of a homogeneous slurry structured metal alloy with thixotropic characteristics maintained substantially at a predetermined temperature in a uniform semisolid condition being in the range of approximately 70% to 90% solid by volume, the remainder being liquid, the method comprising the steps of:

placing the metal preform adjacent a cavity in tooling means having the shape of the desired article;

monitoring the position of a ram relative to the preform by an encoder means;

advancing the ram, rapidly, from a withdrawn position being a predetermined spaced distance from the metal preform defining the beginning of a stroke, as determined by the encoder means, against the metal preform to an advanced second position contiguous with the tooling, thereby defining the end of the stroke, for impressing the preform into the cavity of the tooling, the spaced distance being adequate to preclude an undesirable condition from occurring including at least one of substantial heat drain from the preform and forced entry of air into the cavity and splashing of the semisolid metal outside of the cavity.

* * * * *